US010908546B2

(12) United States Patent
Naruse et al.

(10) Patent No.: US 10,908,546 B2
(45) Date of Patent: Feb. 2, 2021

(54) IMAGE FORMING APPARATUS AND MANAGEMENT METHOD OF CONSUMABLE ITEM

(71) Applicant: CANON KABUSHIKI KAISHA, Tokyo (JP)

(72) Inventors: Taketomo Naruse, Yokohama (JP); Akiyoshi Sahara, Funabashi (JP); Takayuki Ochiai, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/821,698

(22) Filed: Mar. 17, 2020

(65) Prior Publication Data

US 2020/0218189 A1 Jul. 9, 2020

Related U.S. Application Data

(63) Continuation of application No. 16/039,054, filed on Jul. 18, 2018, now Pat. No. 10,627,764.

(30) Foreign Application Priority Data

Aug. 10, 2017 (JP) ..... 2017-156148

(51) Int. Cl.
*G03G 15/00* (2006.01)
*B41J 2/175* (2006.01)
(Continued)

(52) U.S. Cl.
CPC ..... *G03G 15/553* (2013.01); *B41J 2/17546* (2013.01); *B41J 29/13* (2013.01);
(Continued)

(58) Field of Classification Search
CPC ..... G03G 15/553; G03G 15/5079; G03G 21/1878; G03G 2221/1663; B41J 2/16508; B41J 2/17546; B41J 29/13
(Continued)

(56) References Cited

U.S. PATENT DOCUMENTS 6,771,924 B2 8/2004 Matsuguma ..... 399/299
8,160,460 B2 4/2012 Yokochi ..... 399/12
(Continued)

FOREIGN PATENT DOCUMENTS

JP 2009-008756 1/2009

*Primary Examiner* — Hoan H Tran
(74) *Attorney, Agent, or Firm* — Venable LLP

(57) ABSTRACT

The image forming apparatus manages information on a consumable item by a management chip and includes a control unit configured to control the management chip, and the management chip includes: a chip-side storage unit whose storage area is made up in units of blocks; a simultaneous writing unit configured to simultaneously write information on the consumable item in units of the blocks in the chip-side storage unit; and a predetermined unit writing unit configured to write information on the consumable item in predetermined units smaller than the block unit in the chip-side storage unit, and the control unit performs control so as to write information on the consumable item by the simultaneous writing unit at timing at which there is time constraint and performs control so at to write information on the consumable item by the predetermined unit writing unit at timing at which there is no time constraint.

22 Claims, 9 Drawing Sheets

(51) Int. Cl.

| | |
|---|---|
| ***G03G 21/18*** | (2006.01) |
| ***B41J 29/13*** | (2006.01) |
| *B41J 2/165* | (2006.01) |

(52) U.S. Cl.
CPC ..... *G03G 15/5079* (2013.01); *G03G 21/1878* (2013.01); *B41J 2/16508* (2013.01); *G03G 2215/0697* (2013.01); *G03G 2221/1663* (2013.01)

(58) Field of Classification Search
USPC ..... 399/9, 12, 24, 25, 27, 107, 110, 111
See application file for complete search history.

(56) References Cited

U.S. PATENT DOCUMENTS

| | | | | |
|---|---|---|---|---|
| 8,582,988 | B2 | 11/2013 | Rapkin et al. | 399/24 |
| 8,805,212 | B2 | 8/2014 | Mimura | 399/24 |
| 9,116,492 | B2 * | 8/2015 | Kawana | G03G 15/553 |
| 9,465,343 | B2 | 10/2016 | Kamasuka | G03G 15/556 |
| 9,594,897 | B2 * | 3/2017 | Lee | G03G 21/1892 |
| 10,044,900 | B2 * | 8/2018 | Sasaki | G03G 15/55 |
| 10,532,578 | B2 * | 1/2020 | Koganehira | B41J 2/1752 |
| 2007/0150326 | A1 | 6/2007 | Nakao et al. | 705/8 |
| 2011/0013916 | A1 | 1/2011 | Katoh | 399/25 |

* cited by examiner

IMAGE FORMING APPARATUS AND MANAGEMENT METHOD OF CONSUMABLE ITEM

This application is a continuation of application Ser. No. 16/039,054 filed Jul. 18, 2018, currently pending, and claims priority under 35 U.S.C. § 119 to Japan Application 2017-156148, filed Aug. 10, 2017; and the contents of all of which are incorporated herein by reference as if set forth in full.

BACKGROUND OF THE INVENTION

Field of the Invention

The present invention relates to an image forming apparatus, a management method of a consumable item, and a storage medium.

Description of the Related Art

In an image forming apparatus, a consumable item, for example, such as an ink tank and toner, is used and in the case where the consumable item has been consumed, the consumable item is exchanged with a new consumable item. Further, in recent years, an image forming apparatus is known, which is capable of appropriately managing the amount of remaining consumable item by storing the amount of remaining consumable item (or the amount of used consumable item). For example, Japanese Patent Laid-Open No. 2009-8756 has disclosed an image forming apparatus that uses information necessary for management of a consumable item to control the printing operation by writing the information in a memory chip mounted on the consumable item of the image forming apparatus.

In this image forming apparatus of Japanese Patent Laid-Open No. 2009-8756, information at the time of manufacture is stored in a ROM area, information on a new item, a used item, and so on, which is rewritten only once, is stored in an OTP (One Time Programmable) area, and further, information on the amount of remaining consumable item is stored in an R/W area (rewritable area).

However, as in the image forming apparatus of Japanese Patent Laid-Open No. 2009-8756, in the case where a plurality of memory areas is provided in the memory chip (consumable item), the cost is raised accordingly, and therefore, for example, writing information on the amount of remaining consumable item also in an OTP area, which is comparatively inexpensive, can be under study by taking into consideration the cost.

However, in the case where a memory whose write speed is comparatively slow, like the OTP area, is adopted in a memory chip mounted on the consumable item of the image forming apparatus, there is a possibility that a decrease in throughput of printing will result. The present invention has been made in view of these problems and an object is to reduce a decrease in throughput of image formation while improving accuracy of management of a consumable item.

SUMMARY OF THE INVENTION

The present invention is an image forming apparatus that manages information on a consumable item by a management chip attached to the consumable item, the image forming apparatus including: a control unit configured to control the management chip, and the management chip includes: a chip-side storage unit whose storage area is made up in units of blocks; a simultaneous writing unit configured to simultaneously write information on the consumable item in units of the blocks in the chip-side storage unit; and a predetermined unit writing unit configured to write information on the consumable item in predetermined units smaller than the block unit in the chip-side storage unit, and the control unit performs control so as to write information on the consumable item by the simultaneous writing unit at timing at which there is time constraint and performs control so as to write information on the consumable item by the predetermined unit writing unit at timing at which there is no time constraint.

Further features of the present invention will become apparent from the following description of exemplary embodiments with reference to the attached drawings.

DESCRIPTION OF THE EMBODIMENTS

In the following, embodiments of the present invention are explained in detail with reference to the drawings. The following embodiments are not intended to limit the present invention and all combinations of features explained in the present embodiments are not necessarily indispensable to the solution of the present invention. In addition, in the following explanation, explanation is given by attaching the same symbol to the same configuration.

First Embodiment

Figure 1A:
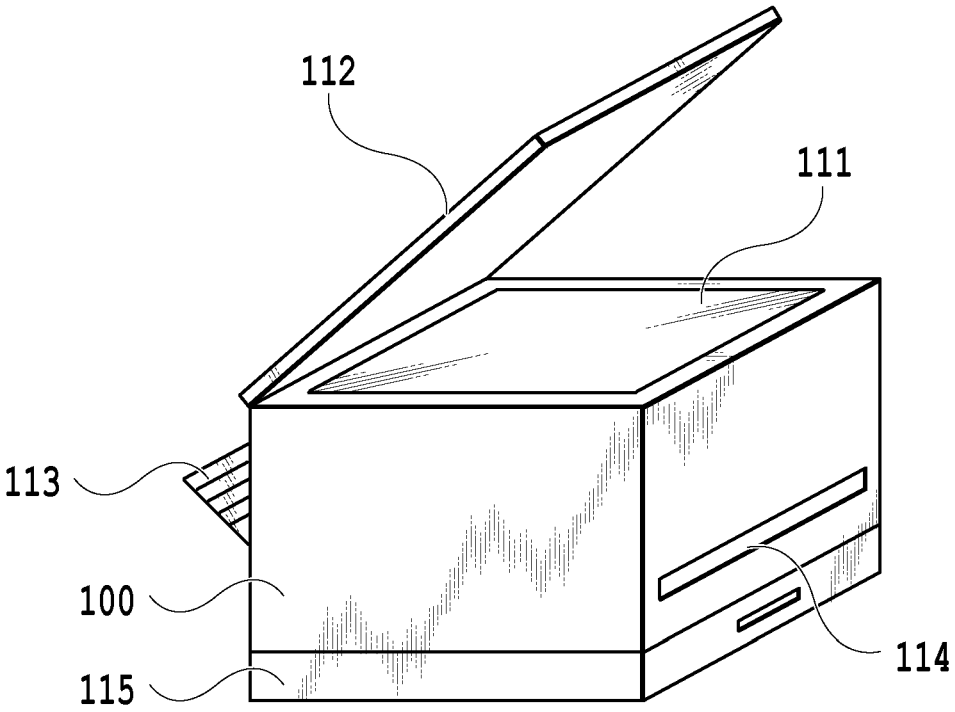
FIG. 1A is a diagram showing an external appearance of an MFP.
Figure 1B:
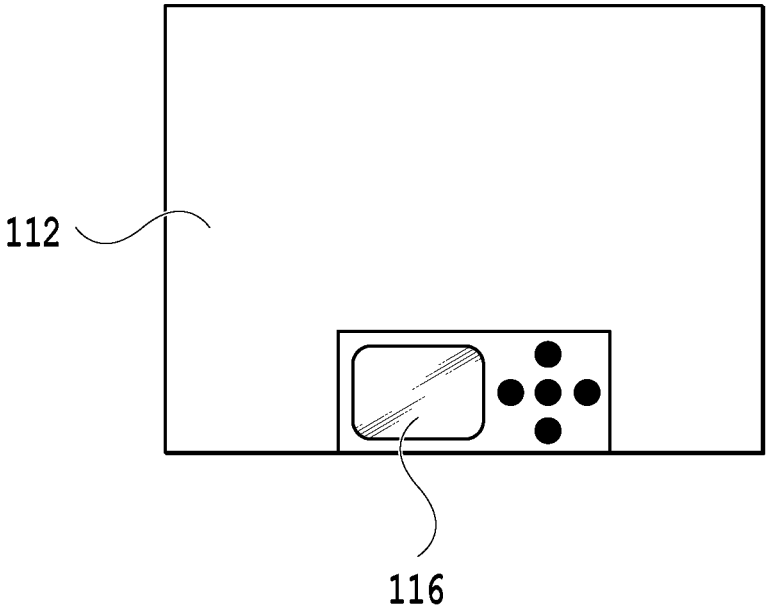
FIG. 1B is a top diagram of the MFP.

FIG. 1A is a diagram showing an external appearance of an MFP 100 and FIG. 1B is a diagram (top diagram) showing the top of the MFP 100. Here, MFP is an abbreviation of Multi Function Printer and refers to an apparatus that scans and electronizes a sheet, prints an electronized document, and so on.

In the present embodiment, explanation is given by using the MFP 100 as an example of an image forming apparatus, but it may also be possible to use, for example, a copy machine, a facsimile machine, and so on in place of the MFP 100. Further, the printing method is not necessarily limited to an ink jet printer, a full-color laser beam printer, a monochrome printer, and so on.

In the following, each unit of the MFP 100 is explained by using the external appearance diagram in FIG. 1A and the top diagram in FIG. 1B. A document table 111 is a transparent table made of glass on which a sheet is loaded and which is used at the time of reading by a scanner. A document lid 112 is a lid for preventing reading light of a scanner from leaking to the outside at the time of reading a sheet by a scanner.

A printing sheet insertion port 113 is an insertion port at which sheets of various sizes are set (that is, a printing sheet feed unit). Sheets set at the printing sheet insertion port 113 are conveyed one by one to a print engine 128, to be described later, and after printing processing is performed, discharged from a printing sheet discharge port 114.

A cassette 115 is a printing sheet feed unit different from the printing sheet insertion port 113. Here, for example, by setting sheets of A4 at the printing sheet insertion port 113 and sheets of A3 in the cassette 115, it is possible for a user to perform a print job to perform printing on the sheet of A3 and the sheet of A4 without the need to walk to the MFP 100 at the time of changing the sheets.

An operation display unit 116 is a display screen on which an image, an operation menu, and so on are displayed and as shown in the top diagram in FIG. 1B, arranged on the top of the document lid 112. In addition, the operation display unit 116 includes, for example, a cross key used to move a cursor displayed on the operation display unit 116, and the like, and further, buttons and the like for performing various functions.

Figure 2A:
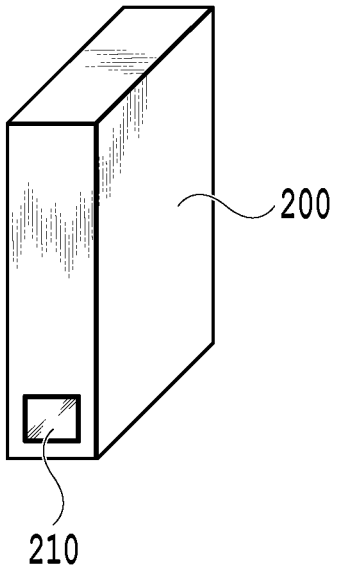
FIG. 2A is a diagram showing an external appearance of an ink tank.
Figure 2B:
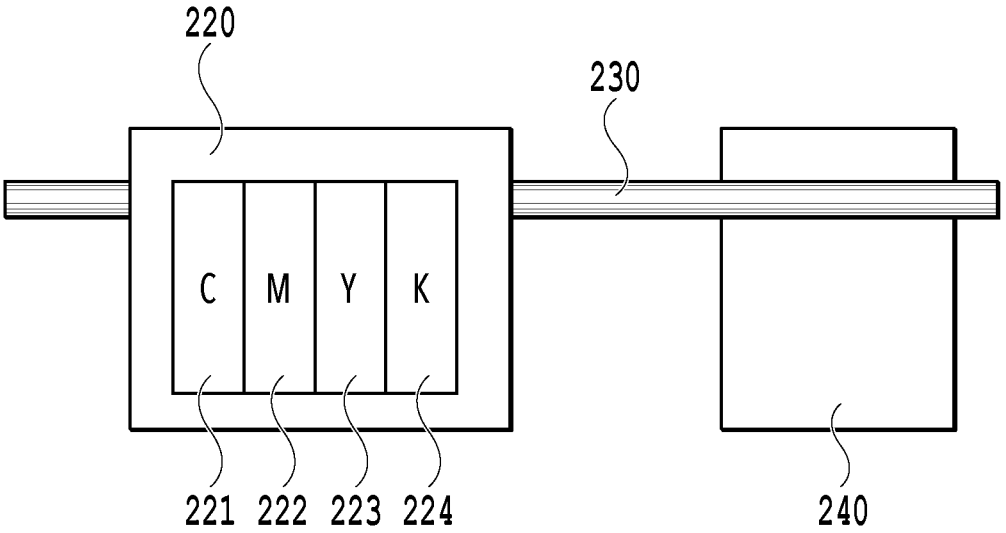
FIG. 2B is a diagram showing an external appearance of a print head.

FIG. 2A is a diagram showing an external appearance of an ink tank 200 and FIG. 2B is a diagram showing an external appearance of an ink tank movable unit. The ink tank 200 stores ink (that is, ink is sealed in the ink tank 200). Then, the ink is supplied to a print head 220 from a supply port provided at the bottom of the ink tank 200. Further, as shown in FIG. 2A, a management chip 210 is mounted on the ink tank 200 and furthermore, in the management chip 210, an IC (Integrated Circuit) for communicating with the MFP 100 is incorporated. The MFP 100 controls the management chip 210 by communicating with the IC. Specifically, the MFP 100 performs control so as to write information relating to the ink tank 200 in the management chip 210. There is a case where the ink tank 200 is simply called a consumable item.

The print head 220 shown in FIG. 2B forms an image on a printing sheet conveyed from the printing sheet insertion port 113 by reciprocating on a shaft 230 and ejecting ink at predetermined timing.

It is possible to attach ink tanks 221 to 224 to the print head 220 and the ink supplied from the ink tanks 221-224 is ejected from the ejection portion of the print head 220.

In the present embodiment, as the ink tanks 221 to 224, ink tanks filled with inks whose colors are different from one another are attached to the print head 220. Specifically, as the ink tank 221, a "cyan" ink tank, as the ink tank 222, a "magenta" ink tank, as the ink tank 223, a "yellow" ink tank, and as the ink tank 224, a "black" ink tank are attached to the print head 220.

Here, in the case where an incorrect ink tank (that is, an ink tank different from the ink tank scheduled to be attached) is attached to the print head 220, it is not possible to correctly form an image desired by a user, and therefore, the MFP 100 displays an error on the operation display unit 116.

In the case where a predetermined time elapses after printing is completed, the ejection portion of the print head 220 dries, and therefore, a cap 240 moves to a capping position and covers the ejection portion of the print head 220 in order to prevent drying.

Figure 3:
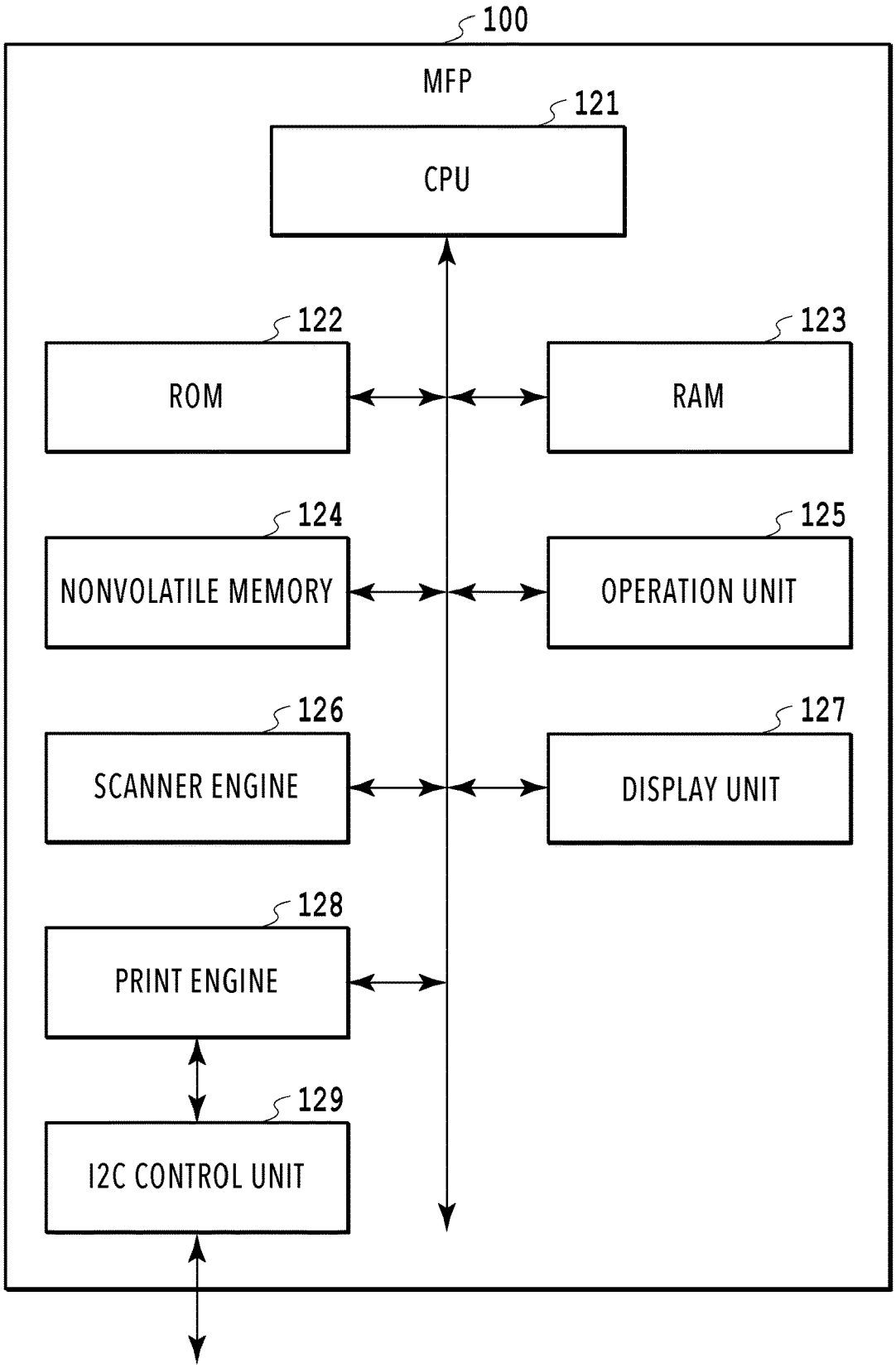
FIG. 3 is a diagram showing a hardware configuration of the MFP.

FIG. 3 is a hardware configuration diagram of the MFP 100. The MFP 100 mainly includes a CPU 121, a ROM 122, a RAM 123, a nonvolatile memory 124, an operation unit 125, a scanner engine 126, a display unit 127, the print engine 128, and an I2C control unit 129. These blocks are connected to one another by, for example, an internal bus as shown in FIG. 3.

The CPU (Central Processing Unit) 121 is a system control unit and controls the entire MFP 100. For example, in the case where printing processing is performed, the CPU 121 writes information relating to the ink tank 200, such as the amount of used ink, in the nonvolatile memory 124 and after this, performs control so as to write the information in the management chip 210 at predetermined timing.

The ROM (Read Only Memory) 122 stores fixed data, such as control programs executed by the CPU 121, a data table, and an OS program. The RAM (Random Access Memory) 123 includes a DRAM (Dynamic RAM) that needs a backup power source, and the like. The RAM 123 is also used as a main memory and a work memory of the CPU 121.

The nonvolatile memory 124 is an apparatus-side storage unit and is an auxiliary storage device that stores predetermined data (for example, setting values of a user, use situations of the apparatus, and so on) even in the case where the power source of the MFP 100 is turned off. The nonvolatile memory 124 includes a memory, for example, such as an EEPROM (Electrically Erasable Programmable Read-Only Memory). Data stored in the nonvolatile memory 124 also includes information relating to the currently attached ink tank 200 and the information is associated with identification information (for example, a manufacture number and the like) on the ink tank 200.

Further, part of information stored in the management chip 210 (in detail, an information storage unit 212, a counter unit 213, to be described later) is stored also in the nonvolatile memory 124. In particular, the writing processing of a counter value in the counter unit 213 takes time comparatively for writing, and therefore, writing in the nonvolatile memory 124 is performed with priority, whose speed of writing processing is higher than that of the counter unit 213. Then, after the information is written in the nonvolatile memory 124, the information is written in the management chip 210 by the CPU 121. Further, at the time of activation of the power source, in the case where the information of the nonvolatile memory 124 does not coincide with the information of the counter unit 213 of the management chip 210, correction processing is performed based on one of the values.

The operation unit 125 is a part of the operation display unit 116 and includes a cross key, buttons, and so on and is used for a user to give instructions to the MFP 100. As described above, by the operation display unit 116 including the operation unit 125, such as a touch panel, it is possible for a user to perform the touch operation. The scanner engine 126 converts a document into electronic data by optically reading the document by a CIS image sensor (contact-type image sensor) and stores the electronic data in the RAM 123.

The display unit 127 includes an LCD (Liquid Crystal Display) and the like and provides a user interface as described above. The print engine 128 performs various kinds of image processing, such as binarization processing and halftone processing, for image data and forms an image on a sheet.

The I2C control unit 129 is connected to an I2C interface and performs communication control in conformity with the communication scheme of I2C with a microcomputer 211 of the management chip 210, which is an I2C slave connected to the I2C interface.

The above-described configuration is an example and it may also be possible for the MFP 100 to include hardware other than the hardware shown schematically. Further, in FIG. 3, a plurality of blocks may be integrated into one block or one block may be divided into two or more blocks. That is, it is possible for each apparatus to take any configuration in a range where processing as will be described later can be performed.

Figure 4:
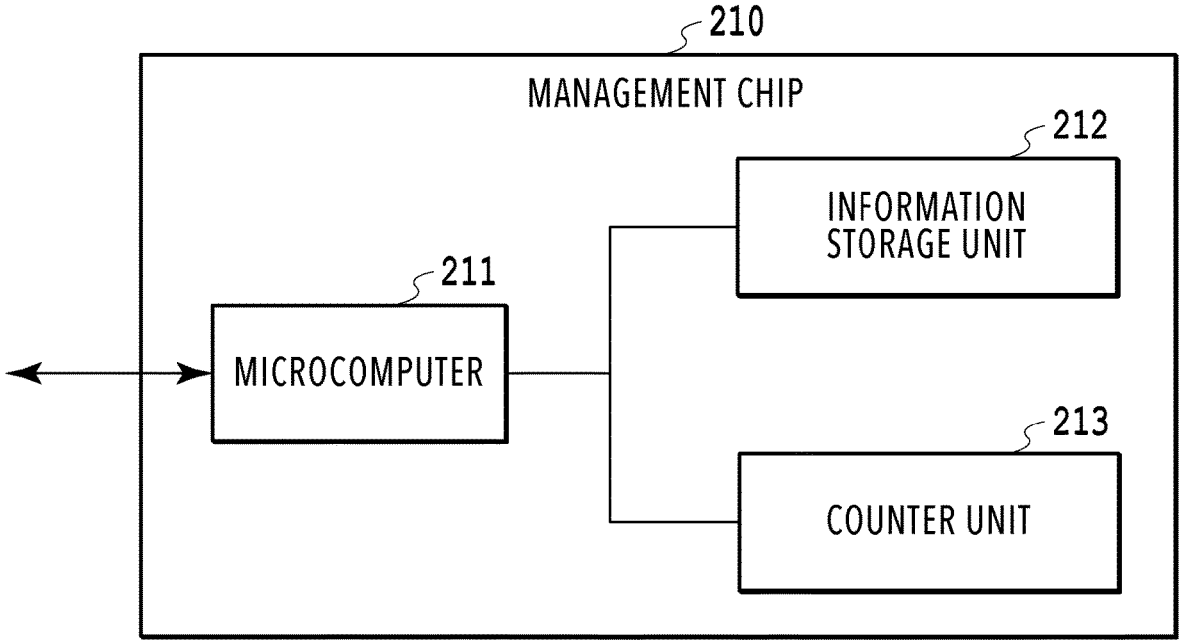
FIG. 4 is a diagram showing a hardware configuration of a management chip.

FIG. 4 is a diagram showing the configuration of the management chip 210 of the ink tank 200. The management chip 210 includes the microcomputer 211, the information storage unit 212, and the counter unit 213. The microcomputer 211 is connected with the I2C control unit 129 of the MFP 100, which is an I2C master, by the I2C interface and further, transmits read or write instructions to the information storage unit 212 and the counter unit 213. That is, the microcomputer 211 functions as a memory writing unit (simultaneous writing unit and predetermined unit writing unit).

The information storage unit 212 includes a memory, for example, such as an EEPROM, and in the information storage unit 212, information necessary for control of the ink tank 200 (for example, information, such as the color of the ink tank, the model number of the MFP 100, and the manufacture number, and so on at the time of factory shipping) is stored. Due to this, even in the case where a user incorrectly attaches the ink tank 200 to the MFP 100, it is possible for the MFP 100 to notify a user of that. Specifically, in the case where the ink tank of "magenta" is attached to the position of the ink tank 221 (that is, the position of the ink tank of "cyan"), a display to the effect that the attachment position is incorrect is displayed on the display unit 127.

The counter unit 213 includes a memory, such as an OTP-ROM (One Time Programmable ROM). The OTP-ROM corresponds to a chip-side storage unit and the OTP-ROM includes a fuse-type that burns off a wire, an anti-fuse type that destroys a MOS insulation film, and so on. Generally, the OTP-ROM is less expensive than the EEPROM, but the write speed is slower than that of the EEPROM and the writing time of the OTP-ROM is longer than the writing time of the EEPROM.

Further, the above-described configuration is an example and the management chip 210 may include hardware other than the hardware shown schematically. Furthermore, in FIG. 4, as in FIG. 3, a plurality of blocks may be integrated into one block or one block may be divided into two or more blocks.

Figure 5A:
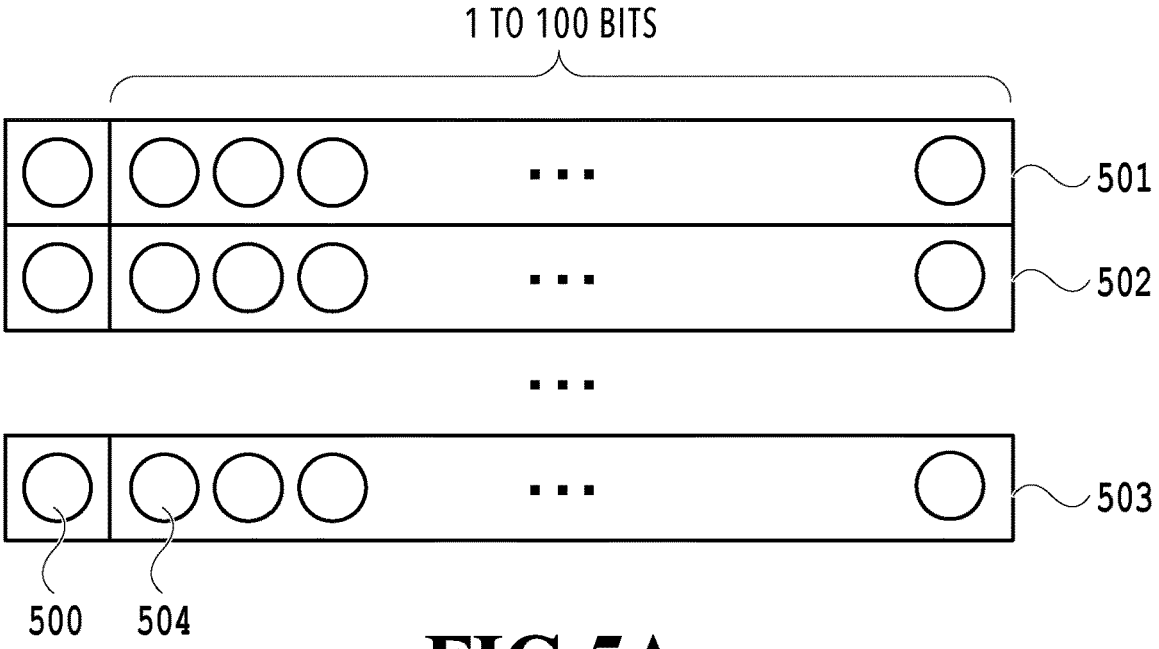
FIG. 5A is a diagram showing a configuration of a counter unit.

FIG. 5A is a diagram showing the configuration of the counter unit 213 and shows the counter unit 213 (that is, the configuration of OTP-ROM) at the bit level.

As the configuration thereof, the counter unit 213 is divided into 100 blocks, that is, block 1 (501) to block 100 (503) (that is, the counter unit 213 is made up in units of blocks). Further, at the top of those blocks, a block management bit (management bit area) 500 is provided. In the example shown in FIG. 5A, in the counter unit 213, a 100-bit counter is mounted on each block and there are 100 blocks as described above, and therefore, a 10,000-bit counter is implemented. The counter unit 213 starts count from 10,000 and decrements count to 9,999, 9,998, and so on and sets the counter to 0 in the case where all the bits are deleted (that is, 10,000 is counted).

Figure 5B:
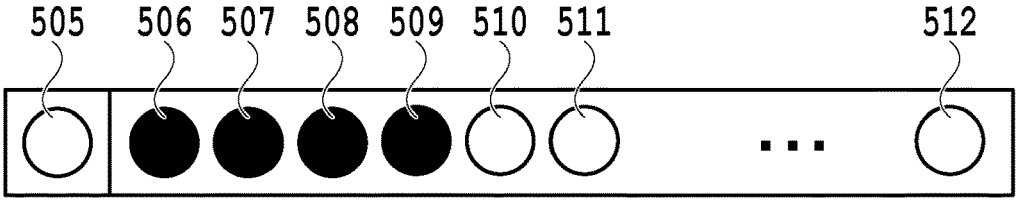
FIG. 5B is a diagram showing count processing in the counter unit.
Figure 5C:
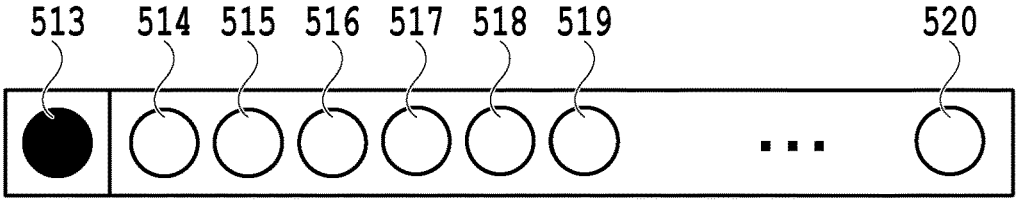
FIG. 5C is a diagram showing count processing in the counter unit.
Figure 5D:
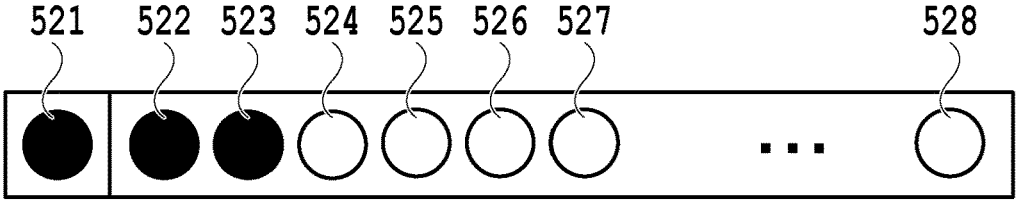
FIG. 5D is a diagram showing count processing in the counter unit.

Next, by using FIG. 5B to FIG. 5D, specific count processing (specifically, processing to delete a bit or a block) in the counter unit 213 is explained. That is, FIG. 5B to FIG. 5D are diagrams showing the count processing in the counter unit 213. FIG. 5B is an example of bit deletion and shows an example in which bits are deleted one by one in order from a top bit 506 of the counter (that is, an example in which count is performed in predetermined units (here, minimum units) for each bit). For example, in the case where the counter value is "4", bits are deleted one by one in order from the top bit 506 of the counter, and a bit 507, a bit 508, and a bit 509 are deleted. Further, in this case, on a condition that ink is consumed, a bit 510 is deleted. By deleting bits as described above, it is possible to decrement the counter.

FIG. 5C is an example of block deletion and shows an example in which the entire block is deleted by deleting a block management bit 513. FIG. 5C is suitable to the case where it is desired to delete the counter by a large amount. For example, in the case where it is desired to decrease the counter by 200, it is necessary to delete 200 bits of the counter unit 213 and on a condition that this is processed by the bit deletion shown in FIG. 5B, as described above, the speed of OTP-ROM is comparatively slow, and therefore, the processing takes time. Consequently, by performing the block deletion shown in FIG. 5C (that is, by deleting the block management bit 513), the bits of the entire block are deleted.

It is possible to perform the block deletion on the way of the bit deletion. FIG. 5D is an example of the block deletion and shows as an example in which the entire block is deleted by deleting a block management bit 521 on the way of the bit deletion.

Regarding the count processing shown in FIG. 5B to FIG. 5D as above, in the case where there is time constraint, the block deletion shown in FIG. 5C and FIG. 5D is performed for the OTP-ROM (that is, the amount of used ink is written simultaneously in units of blocks). Further, in the case where there is no time constraint, the bit deletion shown in FIG. 5B is performed (that is, the amount of used ink is written in predetermined units (here, minimum units) of the storage area in the OTP-ROM). Due to this, it is possible to reduce the time required for the count processing. It may also be possible to set the predetermined unit of the storage area in the OTP-ROM in accordance with the amount of used ink. The period of time during which there is time constraint is, for example, the period of time from completion of processing of a print job until the next print job is started, that is, the period of time from completion of printing of a certain page until printing of the next page is started.

Figure 6:
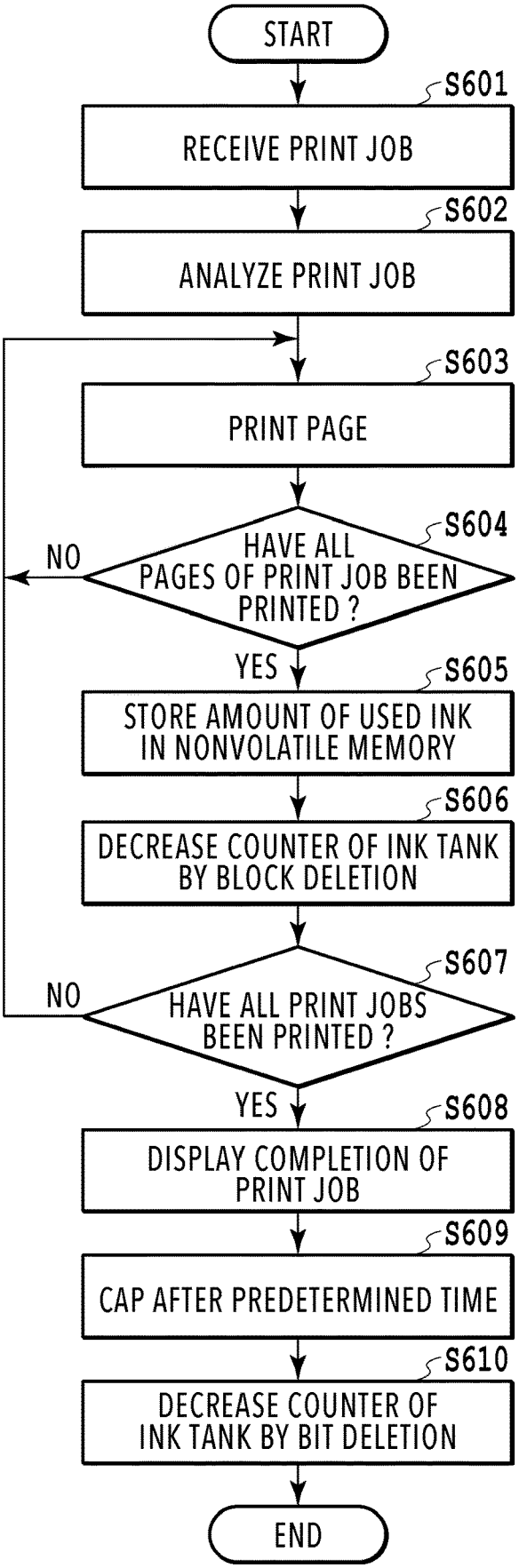
FIG. 6 is a flowchart showing a procedure of printing processing and count processing in the counter unit.

Next, by using a flowchart in FIG. 6, printing processing and count processing in the counter unit 213 of the ink tank 200 are explained. In the processing shown in FIG. 6, a case where a plurality of print jobs is received is shown as an example thereof. Further, as the premise of the present embodiment, while the microcomputer 211 is performing writing of data for the counter unit 213 of the ink tank, the next printing processing is not performed.

In the following, the procedure of the processing shown in FIG. 6 is explained. First, the MFP 100 receives a print job from a PC (Personal Computer) (S601). Here, the print job is printing instructions including electronic data of a plurality of pages to be printed, setting values of printing, and so on.

Upon receipt of a print job, the MFP 100 analyzes the print job (S602). The electronic data of a page to be printed is described in a page description language (PDL) and the like. It is possible for the MFP 100 to specify printing settings and drawing contents by analyzing the page description language.

Next, the MFP 100 performs printing processing of one page by using the print engine 128 (S603). The MFP 100 determines whether or not the printing processing of all the pages making up the print job has been completed (S604) and in the case of determining that the printing processing of all the pages has been completed, that is, the print job is completed (S604 Yes), the MFP 100 advances the processing to step S605.

The MFP 100 calculates the amount of ink used in the print job in the course of the printing processing thereof and stores the amount of used ink in the nonvolatile memory 124 (S605). That is, the CPU 121 stores the amount of ink used inn the print job that is the processing target of this time in the nonvolatile memory 124 at step S605.

The CPU 121 gives the microcomputer 211 instructions to perform the count processing based on the amount of ink used in the print job, which is stored in the nonvolatile memory 124 at step S605 (S606). The instructions that the CPU 121 notifies the microcomputer 211 at step S606 include information corresponding to the number of bits to be deleted. Then, upon receipt of the instructions at step S606, the microcomputer 211 performs writing processing of data corresponding to the amount of used ink for the counter unit 213. For example, in the case where the amount of ink consumed in the print job is 3 mg of cyan, 6 mg of magenta, 3 mg of yellow, and 8 mg of black, the microcomputer 211 writes the count value corresponding to the amount in the counter unit 213 of each of the ink tanks 221 to 224.

However, at step S606, in order to reduce a decrease in throughput of image formation, as a method of decreasing the ink counter (method of writing data), the bit deletion is not performed and only the block deletion is performed. That is, only in the case where it is necessary to delete the block management bit 500, the ink counter is decreased and in the case where it is not necessary to delete the block management bit 500, the processing advances to step 607 without decreasing the ink counter. For example, it is supposed that the number of bits corresponding to the use of 3 mg is 80. As described above, in the present embodiment, one block corresponds to 100 bits. Consequently, in the case such as this, it is not necessary to delete the block management bit 500, and therefore, the CPU 121 does not give the microcomputer 211 instructions to write data for the counter unit 213. Further, for example, it is supposed that the number of bits corresponding to the use of 6 mg is 160. As described above, in the present embodiment, one block corresponds to 100 bits. Consequently, in the case such as this, the CPU 121 requests the microcomputer 211 to delete 100 bits as the amount of used ink. Upon receipt of this request, the microcomputer 211 deletes the block management bit 500, corresponding to deletion of one block.

After step S606, the MFP 100 determines whether or not all the print jobs have been completed (S607) and in the case where all the print job have not been completed (S607 No), the MFP 100 returns the processing to step S603 and in the case where all the print jobs have been completed (S607 Yes), advances the processing to step S608.

The MFP 100 displays that the print jobs have been completed on the display unit 127 at step S608. After displaying that the print jobs have been completed, the MFP 100 displays that the state has made a transition into the standby state for the user.

In the case where an operation (processing) that uses the print head is not performed within a predetermined time, the MFP 100 caps the print head 220 by using the cap 240 in order to prevent the print head 220 from drying (S609). After this, the CPU 121 requests the microcomputer 211 to write the data of the amount of used ink that is not counted between print jobs (S610). For example, in the example described above, the amount of used ink of the remaining 60 bits is not counted, and therefore, the CPU 121 requests the microcomputer 211 to delete 60 bits. Upon receipt of this request, the microcomputer 211 deletes the amount of remaining ink (counter bits) that was not able to be deleted by the block deletion performed at step S606 by bit deletion.

By performing the processing shown in FIG. 6, at step S606, it is possible to delete the counter in units of 100 bits in the same time as in the case of one bit (that is, the counter can be deleted in a short time). As described above, the count processing while the print job is being performed is performed roughly in a short time and the count processing after the print job is completed and the state makes a transition into the standby state is performed in detail. Due to this, in the MFP also in which the next printing processing is not performed from the microcomputer 211 starting the writing processing of data in the counter unit 213 of the ink tank until the writing processing is completed, it is possible to perform the next print job in an early stage. As a result of this, it is possible to improve accuracy of the ink counter while suppressing the influence on printing throughput by the writing processing of data in the counter unit 213 by the microcomputer 211.

Second Embodiment

Figure 7:
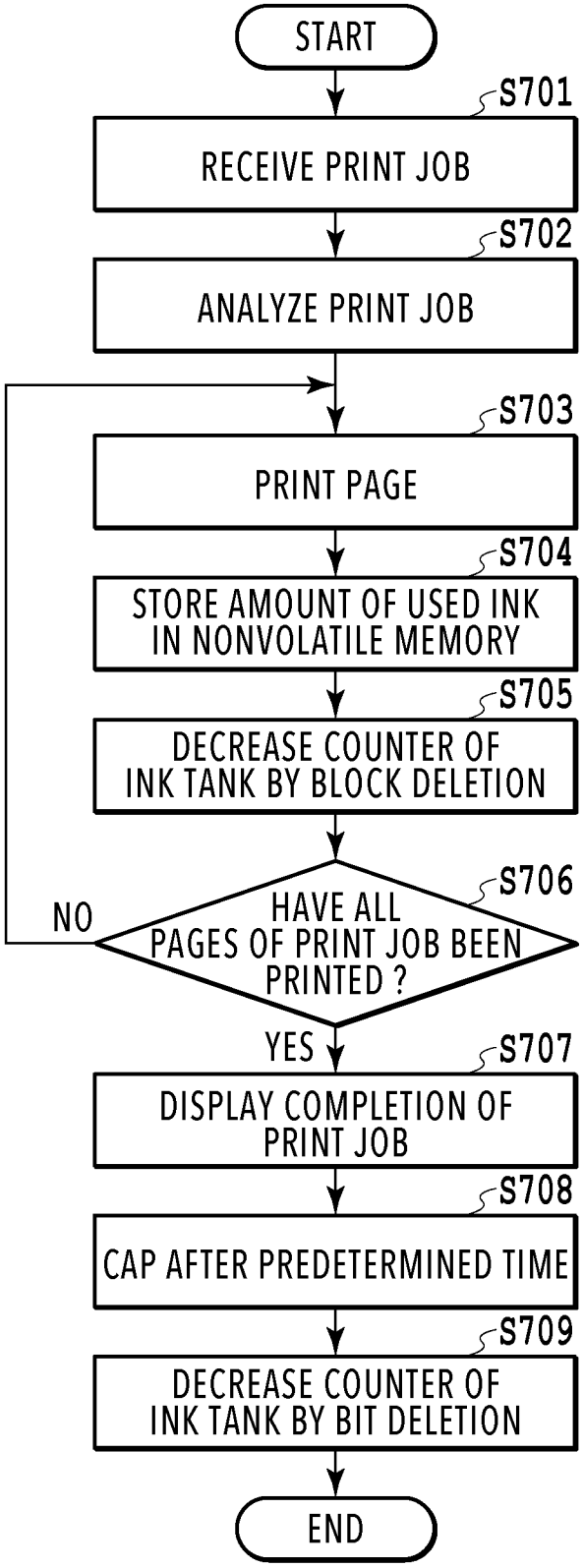
FIG. 7 is a flowchart showing a procedure of printing processing and count processing in the counter unit.

Next, by using FIG. 7, a second embodiment of the present invention is explained. In FIG. 6 described above, the example is shown in which the count processing is performed in the counter unit 213 between print jobs, but in FIG. 7, an example is shown in which in the case where a plurality of pages is printed continuously as a print job, the count processing is performed between pages (between pieces of paper). Further, explanation of the same processing as that of the first embodiment is omitted.

In the following, the procedure of the processing shown in FIG. 7 is explained. First, the MFP 100 receives a print job from a PC (S701). Upon receipt of a print job, the MFP 100 analyzes the print job (S702). Next, the MFP 100 performs printing processing of one page by using the print engine 128 (S703). The MFP 100 calculates the amount of ink used in the printing processing at step S703 in the course of the processing and stores the amount of used ink in the nonvolatile memory 124 (S704). That is, at timing at which printing of one page is completed, the CPU 121 stores the amount of ink used in the printing of one page in the nonvolatile memory 124.

The CPU 121 requests the microcomputer 211 to perform count processing based the amount of ink used in the printing processing at step S703, which is stored in the nonvolatile memory 124 at step S704 (S705). In the instructions that the CPU 121 notifies the microcomputer 211 at step S705, information corresponding to the number of bits to be deleted is included. Then, upon receipt of the instructions at step S705, the microcomputer 211 performs the writing processing of the data corresponding to the amount of used ink for the counter unit 213. However, at step S705, as at step S606 in FIG. 6 described above, as a method of decreasing the ink counter, only the block deletion is performed without performing the bit deletion. That is, only in the case where it is necessary to delete the block management bit 500, the ink counter is decreased and in the case where it is not necessary to delete the block management bit 500, the processing advances to step S706 without decreasing the ink counter. The contents of the specific processing are similar to those at step S606, and therefore, omitted.

The MFP 100 determines whether or not the printing of all the pages of the print job has been completed (S706), and in the case where the printing of all the pages has not been completed (S706 No), the MFP 100 returns the processing to step S703, and in the case where the printing of all the pages has been completed (S706 Yes), advances the processing to step S707.

The MFP 100 displays that the print job has been completed on the display unit 127 at step S707 (S707). In the case where an operation (processing) that uses the print head is not performed within a predetermined time, the MFP 100 caps the print head 220 by using the cap 240 in order to prevent the print head 220 from drying (S708). After this, the CPU 121 requests the microcomputer 211 to write data of the amount of used ink that is not counted between pages (S709). The processing at step S709 is also similar to that at step S610, and therefore, detailed explanation is omitted. By the control of the CPU 121 of the MFP 100, the microcomputer 211 deletes the amount of remaining ink that was not able to be deleted by the block deletion performed at step S705 by bit deletion.

As above, by performing the processing shown in FIG. 7, it is possible to update the count value of the counter unit 213 each time printing of one page is completed. By updating the count value in this manner, compared to the case where the count value is updated after printing of all the pages is completed, it is possible to reduce the possibility that the actual amount of remaining ink and the count value of the ink count deviate from each other even in the case where an unexpected event occurs. Here, in the case where the count value is updated after printing of all the pages is completed, on a condition that a power failure occurs near the end of processing to perform a print job of a large number of pages, the count processing is terminated in the state where the amount of used ink is not written. In this case, the actual amount of remaining ink and the count value of the ink counter deviate from each other, and for example, in the case where the actual amount of remaining ink becomes smaller than the count value of the ink counter and on a condition that ejection control is performed in the state where there is no ink afterward, there is a possibility that damage to the print head 220 results.

Third Embodiment

Figure 8:
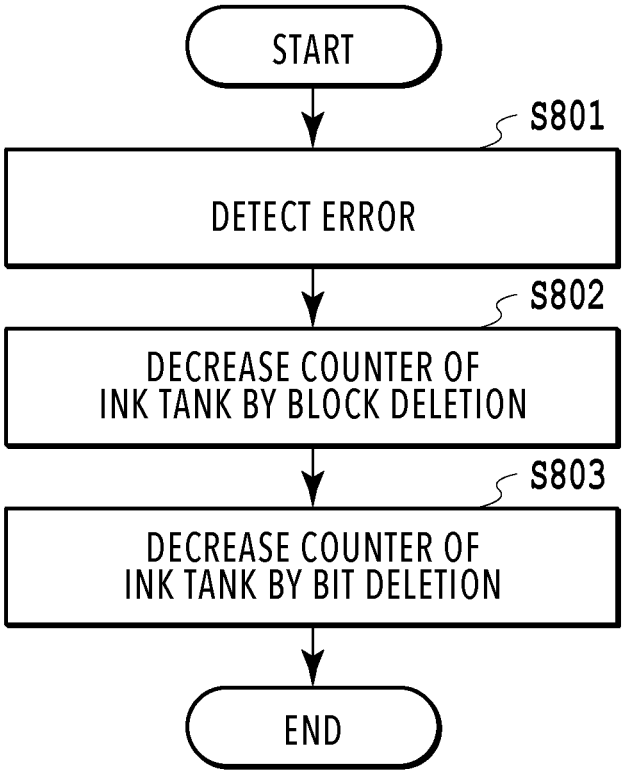
FIG. 8 is a flowchart showing a procedure of count processing in the counter unit in the case where an error has occurred.

Next, by using FIG. 8, a third embodiment of the present invention is explained. FIG. 8 shows count processing of the ink counter in the case where an error, such as a paper jam, occurs during printing. That is, FIG. 8 shows count processing of the ink counter in the case where a print job is not completed normally.

Upon detecting an error (S801), such a paper jam, the MFP 100 starts processing shown in FIG. 8. Here, in the case where a paper jam or the like occurs, in general, a user inspects the inside of the apparatus in order to remove the jammed sheet. In the case where the results of the inspection indicate that a paper jam has occurred on the periphery of the ink tank 200, the user removes the ink tank 200 or the print head 220.

Then, in the case where the ink tank 200 or the print head 220 is removed, on a condition that the count processing in the ink counter is performed in order from the ink tank 221 to the ink tank 224, it is supposed that the count processing is not completed in all the ink tanks. In this case, the ink tank 200 or the print head 220 is removed, and therefore, it is not possible to perform the count processing in the ink counter and as a result of this, there is a possibility that the count value of the ink counter deviates largely from the actual amount of remaining ink.

Consequently, in the case where an error, such as a paper jam, is detected, it is necessary for the microcomputer 211 to quickly perform the count processing in the ink counter. Because of this, the CPU 121 requests the microcomputer 211 to perform block deletion for all the ink tanks of the ink tanks 221 to 224 at step S802. That is, the count processing of the ink counter (subtraction processing) is performed roughly in units of 100 bits.

After the microcomputer 211 performs the block deletion, next, the CPU 121 requests the microcomputer 211 to write data by bit deletion (S803). Specifically, the CPU 121 requests the microcomputer 211 to delete the amount of remaining ink that was not able to be deleted by the block deletion performed at step S802 for each ink tank of the ink tanks 221 to 224 by bit deletion.

By performing the count processing as described above, even in the case where a user has started the restoration task of an error in an early stage, it is possible to reduce the trouble that the entire subtraction processing has been completed for a certain ink tank but the entire subtraction processing has not been completed for another ink tank. That is, the possibility that the value of a specific ink counter deviates largely from the actual amount of remaining ink can be reduced.

Fourth Embodiment

Figure 9:
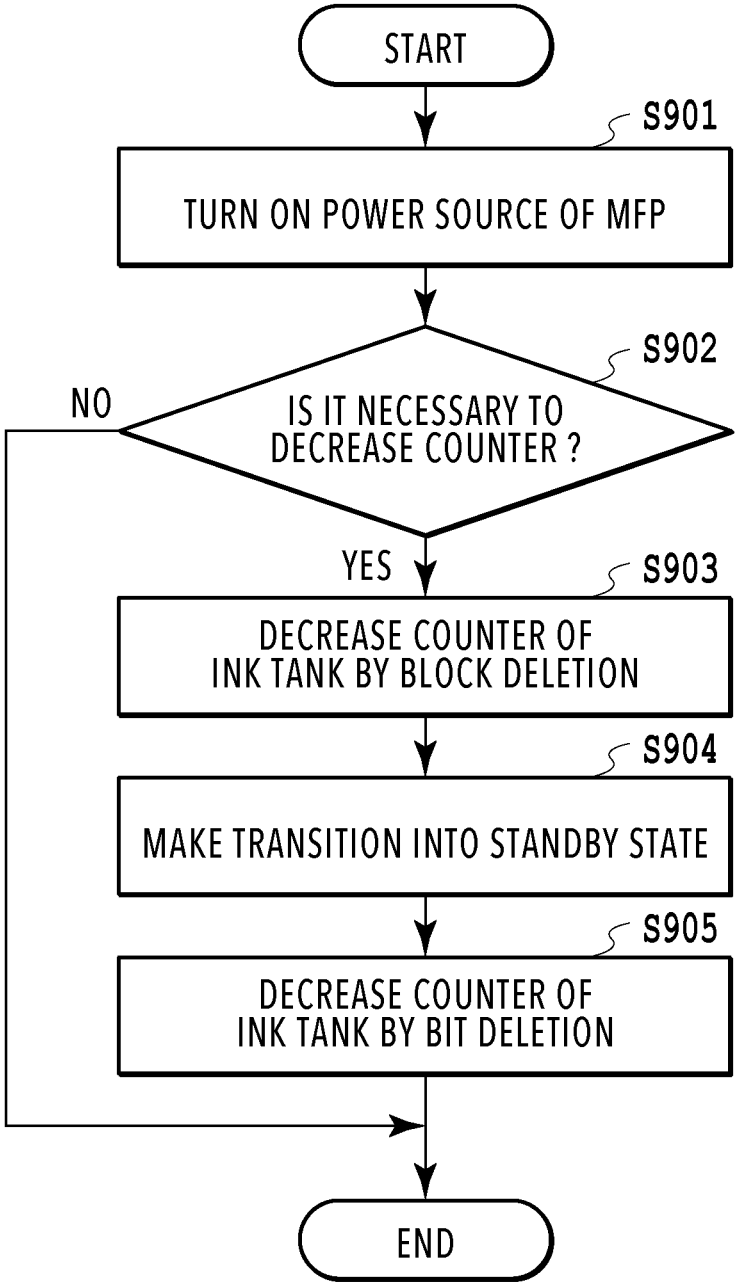
FIG. 9 is a flowchart showing a procedure of processing to correct a count value in the counter unit.

Next, by using FIG. 9, a fourth embodiment of the present invention is explained. FIG. 9 is processing to correct the count value of the ink counter after turning on the power source of the MFP 100. In the case where a user turns on the power source (that is, in the case where the MFP 100 is activated) (S901), the MFP 100 starts the processing shown in FIG. 9.

Next, the MFP 100 determines whether or not it is necessary to perform adjustment (subtraction) for the count value of the ink counter based on the amount of used ink stored in the nonvolatile memory 124 (S902). There is a case where the amount of used ink stored in the nonvolatile memory 124 and the count value of the ink counter are different and in the case such as this, it is necessary to appropriately adjust the amount of remaining ink (amount used) based on one of pieces of information. FIG. 9 shows a case where the count value of the ink counter is corrected based on the amount of used ink stored in the nonvolatile memory 124.

In the case of determining that it is necessary to perform subtraction for the counter value of the ink counter at step S902 (S902 Yes), the MFP 100 advances the processing to step S903.

The CPU 121 requests the microcomputer 211 to perform block deletion during activation of the MFP 100 at step S903. Then, in the case where the MFP 100 makes a transition into the standby state (S904), the CPU 121 performs step S905. Specifically, the CPU 121 requests the microcomputer 211 to delete the amount of remaining ink that was not able to be deleted by the block deletion performed at step S903 by bit deletion.

By performing the procedure of the processing as described above, it is possible to cause the MFP 100 to make a transition into the standby state in an early stage and further, it is possible to adjust (correct) the deviation between the amount of used ink stored in the nonvolatile memory 124 and the counter value of the ink counter in an early stage.

In the above-described embodiment, the microcomputer 211 performs data writing processing upon receipt of the request from the CPU 121, but it may also be possible for the microcomputer 211 to perform the above-described processing by referring to the value of the nonvolatile memory 124 without receiving a request from the CPU 121.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

By the invention of the present application, it is possible to reduce a decrease in throughput of image formation while improving accuracy of management of consumable items.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-156148, filed Aug. 10, 2017, which is hereby incorporated by reference wherein in its entirety.

What is claimed is:

1. A management method of information on the consumable item using a storage area being made up in blocks, wherein the method comprises:

writing information on the consumable item in a block unit of the blocks in the storage area in a first state that an image forming apparatus performs print processing based on first print data and the image forming apparatus have second print data to be performed after a print material based on the first print data is output, wherein the consumable item is attached to the image forming apparatus; and writing information on the consumable item in predetermined unit smaller than the block unit in the storage area in a second state that the image forming apparatus performs print processing based on the first print data and the image forming apparatus does not have the second print data to be performed after the print material based on the first print data is output, wherein the predetermined unit is included in the block.

2. The method according to claim 1, wherein the predetermined unit is a minimum unit of the storage area.

3. The method according to claim 1, wherein the storage area is included in a chip-side storage unit of a management chip attached to the consumable item.

4. The method according to claim 3, wherein the chip-side storage unit is an OTP-ROM.

5. The method according to claim 1, wherein an ink supplied from the consumable item is ejected from a print head.

6. The method according to claim 5, wherein the information on the consumable item in the predetermined unit is written after the print head is capped.

7. The method according to claim 1, wherein the first state is a state where all print jobs have not been processed.

8. The method according to claim 1, wherein the second state is a state where all print jobs have been processed.

9. A management apparatus of information on the consumable item using a storage area being made up in blocks, comprising:

a first writing unit configured to write information on the consumable item in a block unit of the blocks in the storage area in a first state that an image forming apparatus performs print processing based on first print data and the image forming apparatus have second print data to be performed after a print material based on the first print data is output, wherein the consumable item is attached to the image forming apparatus; and a second writing unit configured to write information on the consumable item in predetermined unit smaller than the block unit in the storage area in a second state that the image forming apparatus performs print processing based on the first print data and the image forming apparatus does not have the second print data to be performed after the print material based on the first print data is output, wherein the predetermined unit is included in the block.

10. The management apparatus according to claim 9, wherein the predetermined unit is a minimum unit of the storage area.

11. The management apparatus according to claim 9, wherein the storage area is included in a chip-side storage unit of a management chip attached to the consumable item.

12. The management apparatus according to claim 11, wherein the chip-side storage unit is an OTP-ROM.

13. The management apparatus according to claim 9, wherein an ink supplied from the consumable item is ejected from a print head.

14. The management apparatus according to claim 13, wherein the information on the consumable item in the predetermined unit is written after the print head is capped.

15. The management apparatus according to claim 9, wherein the first state is a state where all print jobs have not been processed.

16. The management apparatus according to claim 9, wherein the second state is a state where all print jobs have been processed.

17. A management method of information on the consumable item using a storage area being made up in blocks, wherein the method comprises:

performing a first writing process to write information on the consumable item in a block unit of the blocks in the storage area in a first state that an image forming apparatus performs print processing based on first print data and the image forming apparatus have second print data to be performed after a print material based on the first print data is output, without performing a second writing process to write information on the consumable item in predetermined unit smaller than the block unit of the blocks in the storage area wherein the consumable item is attached to the image forming apparatus; and performing the second writing process in a second state that the image forming apparatus performs print processing based on the first print data and the image forming apparatus does not have the second print data to be performed after the print material based on the first print data is output, wherein the predetermined unit is included in the block.

18. The method according to claim 17, wherein the predetermined unit is a minimum unit of the storage area.

19. The method according to claim 17, wherein the storage area is included in a chip-side storage unit of a management chip attached to the consumable item.

20. The method according to claim 19, wherein the chip-side storage unit is an OTP-ROM.

21. The method according to claim 17, wherein an ink supplied from the consumable item is ejected from a print head.

22. The method according to claim 17, wherein the first state is a state where all print jobs have not been processed and the second state is a state where all print jobs have been processed.

* * * * *